United States Patent [19]

Wich

[11] 4,192,719

[45] Mar. 11, 1980

[54] METHOD OF MAKING A SHEARFOIL FOR DRY SHAVERS

[75] Inventor: Robert Wich, Oberursel, Fed. Rep. of Germany

[73] Assignee: Braun AG, Frankfurt am Main, Fed. Rep. of Germany

[21] Appl. No.: 898,134

[22] Filed: Apr. 20, 1978

[30] Foreign Application Priority Data

Apr. 21, 1977 [DE] Fed. Rep. of Germany ..... 2717632

[51] Int. Cl.[2] ..... C25D 1/08; C25D 1/20; C25D 7/06

[52] U.S. Cl. ..... 204/11; 204/24

[58] Field of Search ..... 204/11, 3, 4, 24; 30/346.51, 346.53; 76/104 R

[56] References Cited

U.S. PATENT DOCUMENTS

| | | | |
|---|---|---|---|
| 3,498,891 | 3/1970 | Futterer | 204/11 |
| 3,655,528 | 4/1972 | Futterer | 204/11 |
| 3,726,770 | 4/1973 | Futterer | 204/11 |
| 4,039,397 | 8/1977 | Klemm | 204/11 |
| 4,056,992 | 11/1977 | Blume | 30/346.53 |

FOREIGN PATENT DOCUMENTS

| | | | |
|---|---|---|---|
| 519582 | 4/1972 | Switzerland | 30/346.51 |

*Primary Examiner*—T. M. Tufariello
*Attorney, Agent, or Firm*—Michael J. Striker

[57] ABSTRACT

An apertured shearfoil is galvanically provided on its skin-contacting surface with collar-like protuberances surrounding the respective apertures.

7 Claims, 1 Drawing Figure

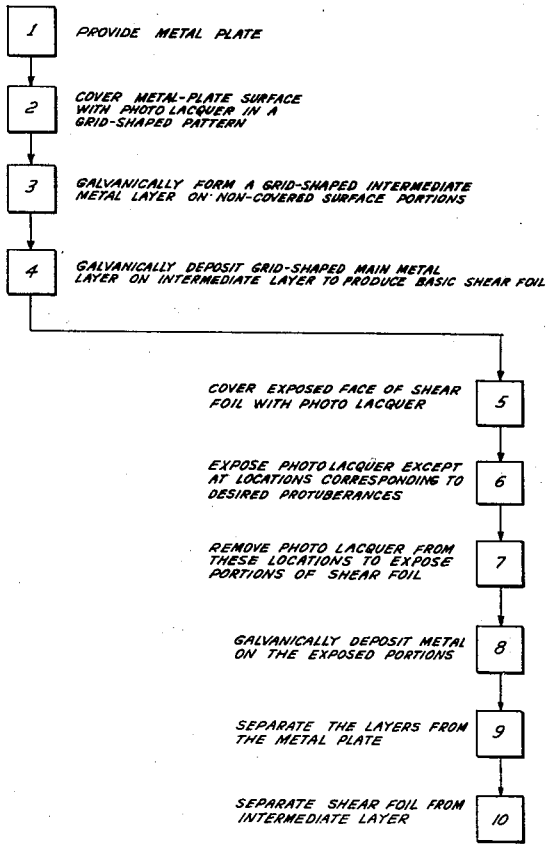

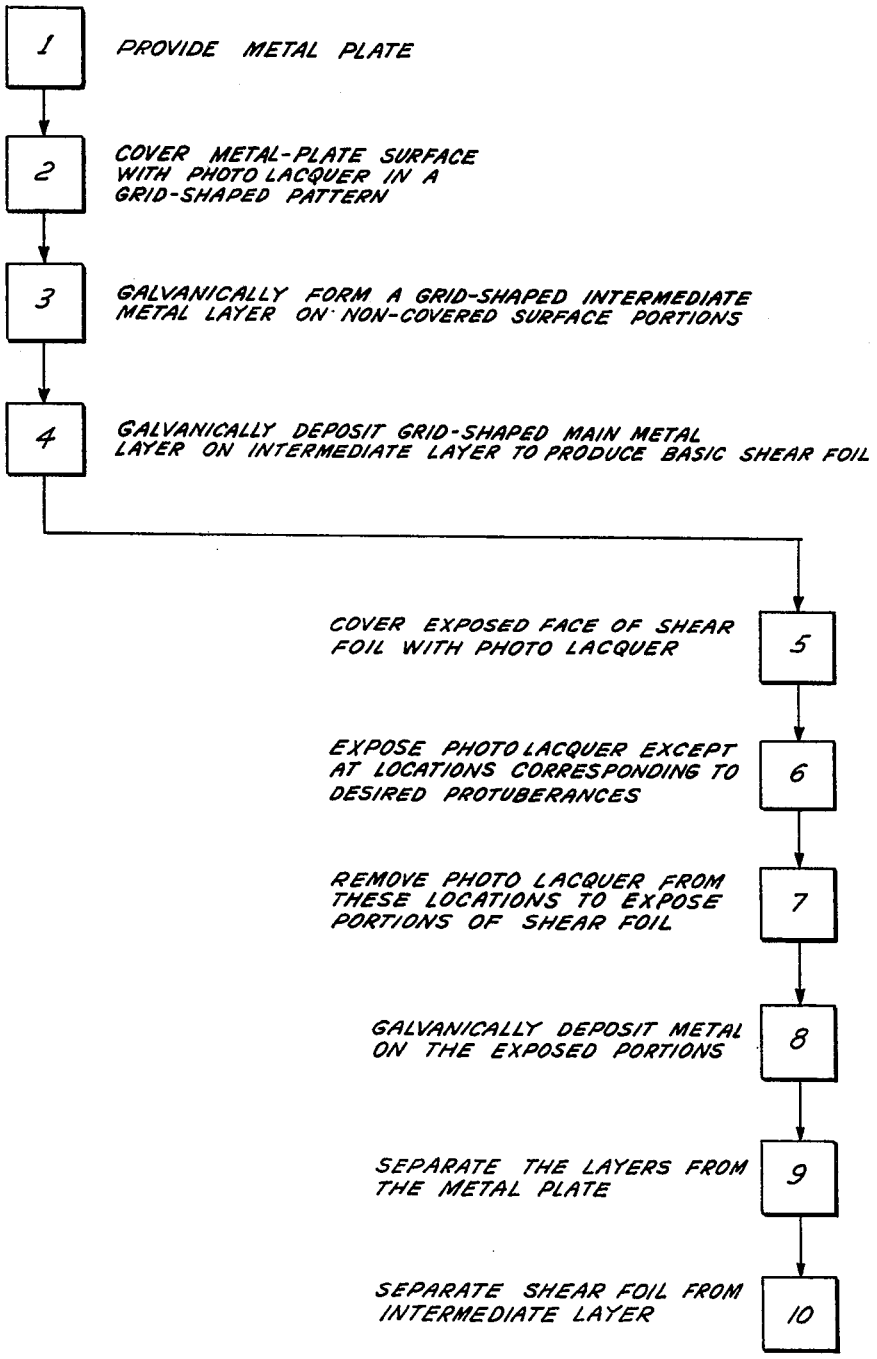
1
PROVIDE METAL PLATE
2
COVER METAL-PLATE SURFACE WITH PHOTO LACQUER IN A GRID-SHAPED PATTERN
3
GALVANICALLY FORM A GRID-SHAPED INTERMEDIATE METAL LAYER ON NON-COVERED SURFACE PORTIONS
4
GALVANICALLY DEPOSIT GRID-SHAPED MAIN METAL LAYER ON INTERMEDIATE LAYER TO PRODUCE BASIC SHEAR FOIL
5
COVER EXPOSED FACE OF SHEAR FOIL WITH PHOTO LACQUER
6
EXPOSE PHOTO LACQUER EXCEPT AT LOCATIONS CORRESPONDING TO DESIRED PROTUBERANCES
7
REMOVE PHOTO LACQUER FROM THESE LOCATIONS TO EXPOSE PORTIONS OF SHEAR FOIL
8
GALVANICALLY DEPOSIT METAL ON THE EXPOSED PORTIONS
9
SEPARATE THE LAYERS FROM THE METAL PLATE
10
SEPARATE SHEAR FOIL FROM INTERMEDIATE LAYER

METHOD OF MAKING A SHEARFOIL FOR DRY SHAVERS

BACKGROUND OF THE INVENTION

The present invention relates to a method of making a shearfoil for dry shavers.

Dry shavers, i.e. electrically operated shavers, have one or more movable blades or cutters. Direct contact of these blades or cutters with the skin of a user must be prevented for reasons of safety and comfort. Therefore, such dry shavers are provided with a very thin—usually metallic—foil which spans the blades or cutters and is provided with a great number of openings through which the beard hair of a user can extend into contact with the moving blades or cutters. These foils are known in the art as shearfoils.

Much thought has been given in the past to the manufacture of these shearfoils because they are a decisive element in the effectiveness of the shaver. Evidently, the shearfoils must be as thin as possible, since the distance from the user's skin at which a beard hair will be cut off by the cutters, depends directly upon the thickness of the shearfoil.

However, there are also other functions which the shearfoil performs. Thus, appropriate shearfoil design will make it possible for the shearfoil to tension the skin of a user as the shaver is moved over the skin, thereby erecting the beard hair and facilitating its entry through the shearfoil apertures. This, evidently, contributes to the quality of the shave which can be otained with the dry shaver.

An advantageous shearfoil construction for this purpose has been proposed in German published application (DOS) No. 1,957,551. The shearfoil which is there disclosed, is provided on its outer (skin-contacting) surface with small protuberances which are arranged proximal to the apertures and which cause a user's skin to be pulled taut as the dry shaver moves over it, thereby erecting the beard hairs which can then more readily enter into the apertures.

Heretofore, this shearfoil could be produced only by mechanical manufacturing methods, which has the disadvantage that a close-tolerance production in large series and at economically acceptable cost is not possible.

SUMMARY OF THE INVENTION

It is, therefore, an object of the invention to provide an improved method of making a dry shaver shearfoil of the type under discussion.

More particularly, it is an object of the invention to provide such a method which permits the shearfoil in question to be manufactured in large series and, therefore, economically but nevertheless with great dimensional accuracy and without sacrificing quality.

In keeping with these objects, and with still others which will become apparent hereafter, one feature of the invention resides in a method of making dry shaver shearfoils which, briefly stated, comprises the steps of producing a shearfoil having a plurality of apertures, applying a coating of an electrically non-conductive substance on one surface of the shearfoil excepting the apertures, galvanically depositing metallic material on the surface about and immediately proximal to the apertures, so as to form collar-like protuberances, and removing the non-conductive substance from the one surface.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE is a diagrammatic illustration of the steps of the novel method, of the flow-diagram type.

DESCRIPTION OF THE PREFERRED EMBODIMENTS

Referring now to the FIGURE it will be seen that it illustrates the method by way of example in ten steps 1–10, in form of a flow chart. The number and sequence of steps shown are, however, not to be considered limiting or exclusive; they have merely been chosen as a convenient and readily understandable way of illustrating and describing the method.

With this in mind it will be noted that to make the basic shearfoil a metallic plate may be provided in step 1, which is then coated on one side with photo lacquer (i.e. electrically non-conductive lacquer) in step 2. The lacquer is applied in form of a grid-shaped pattern corresponding to the shearfoil to be produced. In other words: those spaces of the plate surface are covered by the lacquer where the shearfoil to be produced is later to have holes or apertures.

In step 3 an intermediate foil or layer of metal (preferably, but not necessarily nickel) is galvanically deposited on those portions of the plate surface which are not covered by the photo lacquer, so as to form the intermediate layer in the shape of a grid. The intermediate layer is made thicker than the thickness of the photo lacquer.

In step 4 the thus obtained assembly is used as a bath electrode in a galvanic process, in which an outer layer constituting the actual shearfoil is galvanically deposited in the intermediate layer. The outer layer is preferably of nickel and will be deposited on the intermediate layer and the flanks of the same.

Thus far, the procedure is conventional. However, the thus produced shearfoil is now to be provided (on its surface which in use will contact the face of a dry shaver user) with the aforementioned protuberances.

For this purpose the exposed surface of the shearfoil (the latter still being on the intermediate layer which in turn is on the metal plate) is covered in step 5 with a coating of photo lacquer. This coating is then exposed in step 6 through a transparency having an appropriate pattern of opaque portions, so as to harden those portions of the coating which correspond to the shearfoil parts surrounding the shearfoil apertures. Thereafter, in step 7, the coating is developed; this results in removal of those portions of the coating which were not hardened, i.e. which previously covered the shearfoil openings. All other parts of the shearfoil remain covered by the photo lacquer coating. Subsequently, in the same or in a not separately illustrated further step, the coating is activated, with the result that those parts of the coating which immediately surround the edges of the apertures, are eroded, thus exposing an annular shearfoil portion about each of the apertures. In other words: the entire shearfoil surface is at this time covered by the photo lacquer, exept for narrow exposed annular areas which surround the respective aperture.

Thereafter, in step 8, a metal (preferably nickel) is galvanically deposited on those exposed annular areas; no deposition will occur anywhere else since all other parts of the shearfoil surface are covered by the photo lacquer. On completion of this deposition, which results in formation of the desired protuberances, the photo lacquer coating is removed in the usual manner (known per se) and the two metal layers (i.e. the intermediate layer and the shearfoil) are removed in step 9 from the metal plate (the matrix), whereupon the shearfoil is separated from the intermediate layer in step 10 and is now available as a finished product.

This finished shearfoil is formed on its inner surface, i.e. the surface which in use will face towards the cutters of the dry shaver, with annular bosses or projections each surrounding one of the apertures. These are formed due to the thickness differential between the intermediate layer and the photo lacquer in step 3.

The outer shearfoil surface, i.e. the one which in use contacts the face of a user, is formed with annular bead-like protuberances surrounding the respective apertures in collar-like manner and serving to pull the user's skin taut and to erect the beard hairs and guide them into the apertures.

As mentioned before, the specific number and sequence of steps as shown in the FIGURE is not to be considered limiting. Various modifications are entirely possible and intended to be embraced herein. For example, the activation of the photo lacquer might be dispensed with. The photo lacquer can advantageously be applied by printing it in the desired pattern. What is important, regardless of the manner of application, is that the edge faces surrounding the apertures (i.e. the edge faces extending from the outer to the inner surface of the shearfoil) remain uncovered and hence conductive. The desired protuberances will therefore be formed even if the activating step (and its concomitant removal of lacquer from a narrow zone about each aperture) is omitted. The bead-like protuberances are formed by metal which becomes deposited on the conductive edge faces and grows outwardly (following the current flow) onto the zone surrounding the respective aperture to form the desired protuberances.

By resorting to the present invention it is possible to produce a shearfoil of the type in question, in very large series and at economically very attractive cost. Further, the tolerance variations can be precisely maintained and the collar-shaped protuberances have the additional advantage of reinforcing the shearfoil and thus increasing its mechanical strength and stability. Because of this latter factor it is possible to utilize the present method for producing shearfoils which are thinner than those without the protuberances, thus permitting a closer shave.

The outer surface of the finished shearfoil may, if desired, be provided in known manner with a platinum coating to improve its smoothness.

It will be appreciated that the invention can be practiced with shearfoils which are not originally produced by galvanic deposition. For example, the basic shearfoil could be of sheet steel (steel foil) in which the apertures are formed by stamping, etching, or in any other suitable manner.

It is emphasized that no attempt has been made to illustrate the shearfoil itself, inasmuch as such shearfoils are known per se and the invention is directed to a method of making the shearfoil.

While the invention has been illustrated and described as embodied in a method of making a dry shaver shearfoil, it is not intended to be limited to the details shown, since various modifications and structural changes may be made without departing in any way from the spirit of the present invention.

Without further analysis, the foregoing will so fully reveal the hist of the present invention that others can be applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a method of making a dry shaver shearfoil capable of erecting the beard hair of a user, the steps of providing a shearfoil having a plurality of apertures and a surface adapted to contact the skin of a user; applying a coating of an electrically non-conductive substance on said surface of said shearfoil, excepting said apertures; galvanically depositing metallic material on said surface only about and immediately proximal to said apertures, so as to form collar-like protuberances adapted to erect a user's bear hair by tensioning the skin when the shearfoil is moved over the skin in contact therewith; and removing said non-conductive substance from said surface.

2. A method as defined in claim 1, wherein said substance is a photo lacquer.

3. A method as defined in claim 1, wherein the step of applying comprises printing said substance onto said one surface.

4. A method as defined in claim 1; and further comprising the step of activating said substance prior to the step of galvanically depositing, so as to remove said substance from said one surface in narrow annular zones about the respective apertures.

5. A method as defined in claim 1, wherein said metallic material is nickel.

6. A method as defined in claim 1, wherein said shearfoil is carried on a substrate which engages an opposite surface of the shearfoil during the preceding steps; and further comprising the subsequent step of separating said shearfoil from said substrate.

7. A method as defined in claim 1, wherein the step of providing comprises forming the shearfoil by galvanic deposition of metallic material on a substrate.

* * * * *